US006722475B2

(12) United States Patent
Miller et al.

(10) Patent No.: US 6,722,475 B2
(45) Date of Patent: Apr. 20, 2004

(54) ELEVATOR SAFETY PLANK ASSEMBLY

(75) Inventors: Michael G. Miller, Littlestown, PA (US); Karl B. Orndorff, Bonneaville, PA (US)

(73) Assignee: Inventio AG, Hergiswil (CH)

( * ) Notice: Subject to any disclaimer, the term of this patent is extended or adjusted under 35 U.S.C. 154(b) by 51 days.

(21) Appl. No.: 10/152,932

(22) Filed: May 22, 2002

(65) Prior Publication Data

US 2003/0217896 A1 Nov. 27, 2003

(51) Int. Cl.[7] ..... B66B 7/08; B66B 11/02
(52) U.S. Cl. ..... 187/266; 187/359; 187/401
(58) Field of Search ..... 187/254, 264, 187/266, 359, 401, 412

(56) References Cited

U.S. PATENT DOCUMENTS 4,249,640 A * 2/1981 Darwent et al. ..... 187/401
4,977,980 A 12/1990 Hifumi
5,353,893 A 10/1994 Sun et al.
5,366,044 A * 11/1994 Jamieson et al. ..... 187/359
5,533,595 A * 7/1996 Narumi et al. ..... 187/266
6,640,935 B1 * 11/2003 Murakami et al. ..... 187/401

FOREIGN PATENT DOCUMENTS

| | | | |
|---|---|---|---|
| EP | 0 985 625 | 3/2000 | |
| JP | 4-303380 A | * 10/1992 | ..... 187/401 |
| JP | 5-097354 A | * 4/1993 | ..... 187/401 |
| JP | 2002087732 | 3/2002 | |
| WO | WO 99/33743 | 7/1999 | |

* cited by examiner

*Primary Examiner*—James W. Keenan
*Assistant Examiner*—Thuy V. Tran
(74) *Attorney, Agent, or Firm*—MacMillan, Sobanski & Todd, LLC

(57) ABSTRACT

A safety plank assembly for mounting on a bottom of an elevator car in a traction-type elevator system includes a pair of parallel extending plank beams connected by a cross support member. A rope sheave is rotatably mounted at each of opposed ends of the plank beams to define a diagonal rope path through the assembly for underslung support of the elevator car. Traction weights and balancing weights can be attached to the beams and provision is made for mounting safety equipment.

20 Claims, 4 Drawing Sheets

ELEVATOR SAFETY PLANK ASSEMBLY

BACKGROUND OF THE INVENTION

The present invention relates generally to traction-type elevator safety systems and, in particular, to an improved elevator safety plank assembly adapted to be attached to an elevator car in a traction-type elevator system.

Elevators and their associated mechanical components are well known. Elevators are used to move people and equipment between floors or levels in multistory buildings or mines. A conventional traction type elevator application includes an elevator car mounted in a car frame attached to a counterweight via a steel wire rope or cable. A machine positioned at the top of a hoistway drives a traction sheave that is engaged with the rope such that the car and the counterweight are suspended. As the machine turns the sheave, friction forces between the grooved surface of the sheave and the rope move the rope and thereby cause the car frame and counterweight to raise and lower in opposite directions in the hoistway. The hoistway typically has a set of at least two vertical beams or rails on which the elevator car moves. The elevator car is coupled to the rails by guide shoes that typically include emergency brakes. The rails absorb side to side loads during operation of the elevator. These side loads, as well as vibration forces from the machine, suspension cable, and brakes are isolated from the interior of the car by various isolation means, including rubber dampers and the like.

Traction-type elevators also often include compensation cables, which cables attach at opposite ends of the bottoms of the elevator car and the counterweight and are operable to compensate for imbalances caused by the weight of the suspension cable when the elevator car and the counterweight are vertically spaced apart. In addition, a traveling or trail cable, which provides electrical power to the elevator car, is connected to the elevator car and travels with the car through the various floors. A device known in the art as a safety plank is attached to the bottom of the elevator car and includes a mounting means for the compensation cable sheaves.

Following the installation of an elevator assembly, the elevator car must be balanced within the hoistway for optimum operation. This requirement to balance the car is inherent in traction-type elevators, because of the imbalance caused by the suspension ropes, the trail cables, the compensation cables as well as the design of the cars within the allowed hoistway space. Prior art balancing practices include the application of a weight frame, adjusting the position of the car frame within the hoistway to achieve balance, and positioning equipment, such as the suspension cable and compensation cable, at predetermined locations in order to balance the car properly. The balancing of the car provides for guide shoes and rail loads within the specified requirements of the shoes and rails. Normally the goal is to achieve a zero load on the guide shoes with the car balanced at the middle of the hoistway. Balancing the elevator car during installations of prior art elevator systems, however, was made more difficult because the elevator systems utilized different components for the component interfacing, assembly, adjustment, and balancing causing each elevator system to be different.

It is desirable, therefore, to provide an assembly operable to include multiple attachments that will allow for balancing of the elevator car on site. It is also desirable to provide an assembly that will combine component interfacing, assembly, adjustment, and balancing into a unitary assembly.

SUMMARY OF THE INVENTION

The safety plank assembly according to the present invention is used with a traction-type elevator having a drive machine at the top of a hoistway in a machine room or mounted at the top of a rail. The assembly includes two spaced apart safety plank beams of C-shape profile extending parallel to one another. When the assembly is mounted on the bottom of an elevator car, the plank beams extend the width of the car from rail to rail. The plank beams are spaced apart by a greater distance than prior art safety plank beams, thus providing better support for the platform and improved isolation means. The plank beams are connected by a cross support member and one or more of end plates, bottom plates and transverse members. A rope sheave is rotatably mounted on each opposed end of the safety plank assembly. Each sheave is oriented to define a diagonal rope path through the assembly for underslung support of the elevator car. A plurality of balancing weights and traction weights can be mounted on the assembly. Safety mounting provisions are included in the assembly for attaching safety equipment such as emergency brakes.

The elevator suspension ropes are routed around the sheaves and between the safety plank beams through apertures in end plates or gaps in end walls of the assembly. Thus, the suspension ropes and the bottom pinch points associated with the sheaves and rope movement are housed within the safety plank assembly, which provides a degree of safety for personnel working under the car. In one embodiment of the safety plank assembly, the sheaves are mounted on two sheave beams attached to the cross support member. The traction weights are installed between the sheave beams on transverse spacer members, and the balancing weights are installed in weight brackets on the main plank beams. In another embodiment of the safety plank assembly, the sheaves are mounted on angled gussets fastened to the bottom plates. The traction weights and balancing weights are installed on transverse members extending between the main plank beams and the cross support member.

The safety plank assembly according to the present invention advantageously includes all component interfacing, assembly, adjustment and balancing in a unitary assembly. The safety plank assembly according to the present invention is designed for installation of the necessary weight required to meet the traction requirements of the machine and ropes. The traction weights can be added either in the factory or at the installation site, before or after the car is installed. The additional weight is added to the safety plank assembly by inserting the necessary amount of cut weight plates at specific locations on the safety plank assembly to balance the car within the hoistway. The safety plank assembly also contemplates the addition of weight to counterbalance the weight of compensation or traveling cables by locating weight plates at other specific locations. The attachment of the compensation cables is accomplished by the use of one weight or a bracket designed for this attachment and located in the safety plank at the necessary location.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
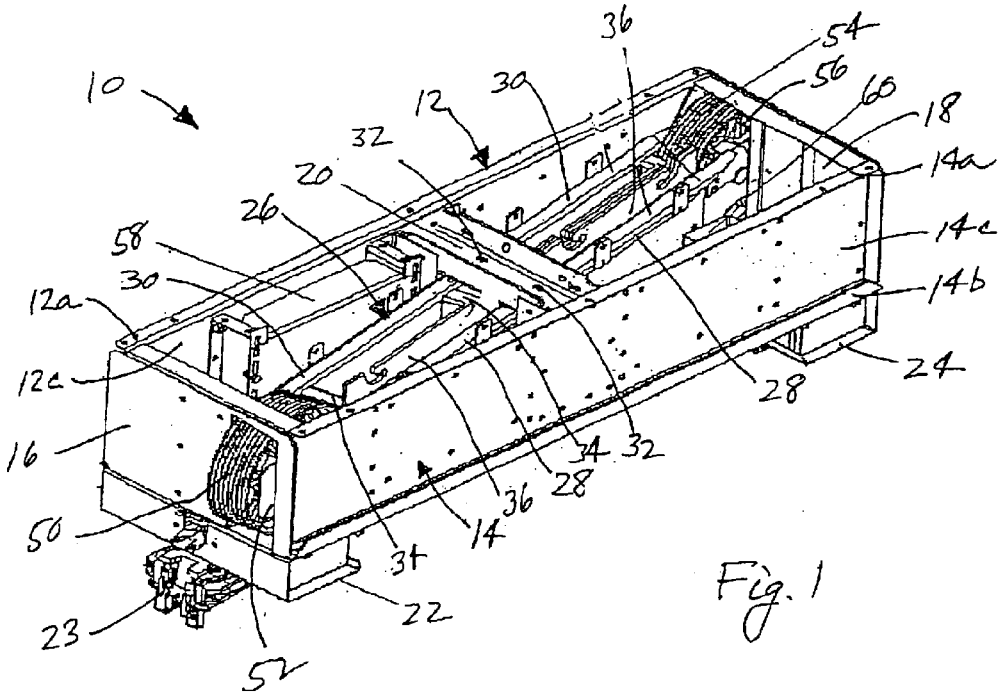
FIG. 1 is a perspective view of a safety plank assembly in accordance with the present invention.
Figure 2:
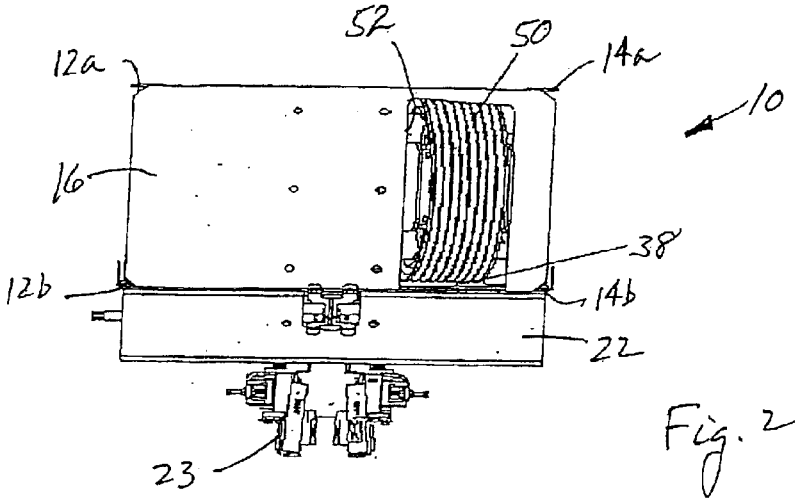
FIG. 2 is a left side view of the safety plank assembly shown in FIG. 1.
Figure 3:
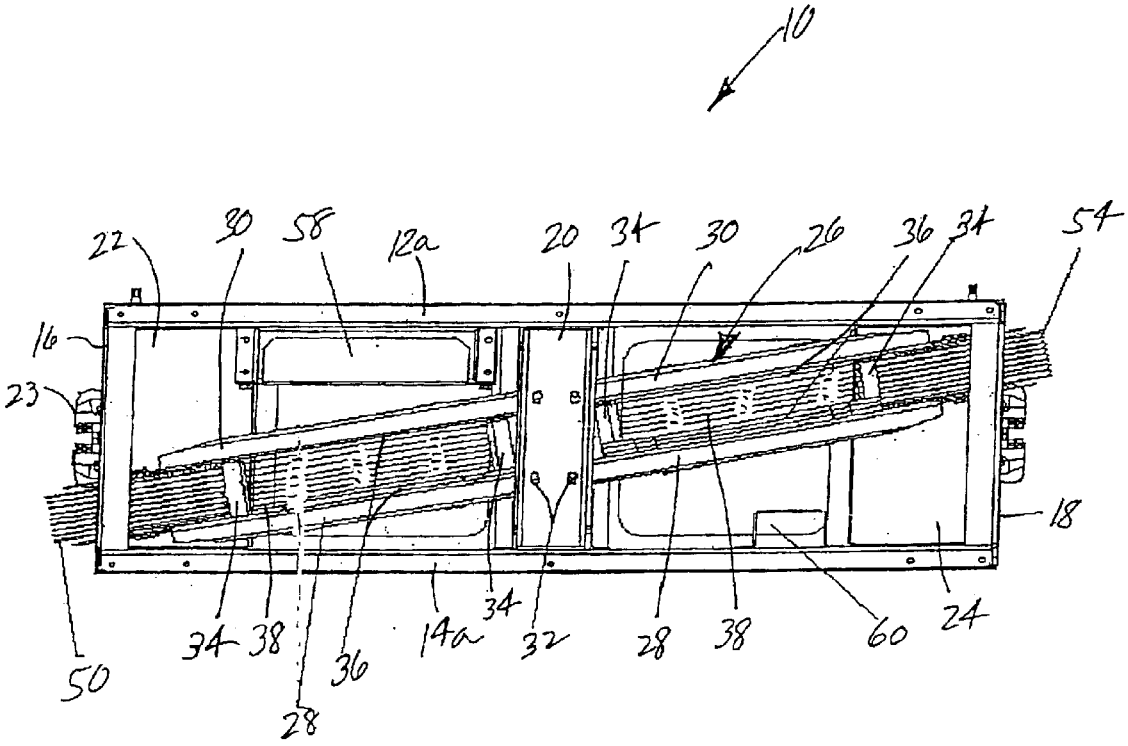
FIG. 3 is a top plan view of the safety plank assembly shown in FIG. 1.

Referring now to FIGS. 1, 2, and 3, an elevator safety plank assembly is indicated generally at 10. The safety plank assembly 10 is operable to be attached to a bottom of an elevator car (not shown). The safety plank assembly 10 includes a first plank beam 12 and a second plank beam 14 extending parallel to one another. The plank beams 12 and 14 are preferably spaced about twenty-four inches apart which is wider than the typical prior art safety planks for better support of the car and better noise and vibration isolation. Each of the plank beams 12 and 14 is generally C-shaped in profile having horizontally outwardly extending upper flanges 12*a* and 14*b* respectively and horizontally outwardly extending lower flanges 12*b* and 14*b* respectively attached to upper and lower edges of generally vertically extending planar bodies 12*c* and 14*c* respectively. The upper flanges 12*a* and 14*b* support elevator platform stringers (not shown).

When the safety plank assembly 10 is attached to the bottom of an elevator car (not shown), the plank beams 12 and 14 extend generally parallel to planes of the front and rear walls of the elevator car. The plank beams 12 and 14 are joined on opposed ends by a first end plate 16 and a second end plate 18. The plank beams 12 and 14 are connected by a cross support member 20 intermediate the end plates 16 and 18. A first safety mounting provision 22 is attached to the lower flanges 12*b* and 14*b* at the first end plate 16 and extends downwardly therefrom for mounting a first safety device 23, such as an emergency brake. A second safety mounting provision 24 is attached in a similar manner at the second end plate 18 and extends downwardly therefrom for mounting a second safety device 25, such as an emergency brake.

A sheave beam assembly is indicated generally at 26 and includes a first sheave beam 28 extending generally parallel to and spaced from a second sheave beam 30. The sheave beams 28 and 30 extend diagonally between one corner of the safety plank assembly 10 formed by the junction of the plank beam 12 and the end plate 18 to an opposite corner formed by the junction of the plank beam 14 and the end plate 16. The sheave beams 28 and 30 pass under the cross support member 20 and are attached thereto by a plurality of fasteners 32. A pair of transverse spacer members 34 are positioned on either side of the cross support member 20 and each member 34 is connected between the inner surfaces of the sheave beams 28 and 30. The sheave beams 28 and 30 can receive one or more traction weights 36 therebetween. The weights 36 are sized to fit on either side of the cross support member 20 and be supported by and between the pairs of the spacer members 34 for improving traction between the sheaves and the suspension rope or cable, outlined in more detail below. The traction weights 36 also extend downwardly short of a diagonal rope path 38 (shown in phantom) for the car suspension cables (not shown) that pass through the safety plank assembly 10 as described below.

A first sheave 50 is rotatably mounted, such as by a roller bearing connection, between the sheave beams 28 and 30 at the end of the sheave beam assembly 26 adjacent the first end plate 16. The first sheave 50 extends through an aperture 52 formed in the first end plate 16. A second sheave 54 is rotatably mounted in a similar manner to the opposite end of the sheave beam assembly 26 adjacent the second end plate 18. The second sheave 54 extends through an aperture 56 formed in the second end plate 18. The rope sheaves 50 and 54 function as an underslung sheave assembly. The ropes or cables (not shown) extend vertically down past the sides of the elevator car (not shown) engaging the sheaves 50 and 54, passing through the apertures 52 and 56 and passing through the safety plank assembly 10 along the rope path 38. Such a construction shields the ropes from service personnel during maintenance.

A first balancing weight bracket 58 is attached to an inner surface of the body 12*c* of the first plank beam 12 and extends from adjacent the cross support member 20 toward the first end plate 16. A second balancing weight bracket 60 is attached to an inner surface of the body 14*c* of the second plank beam 14 between the cross support member 20 and the second end plate 18. The first balancing weight bracket 58 and the second balancing weight bracket 60 also can functions as an attachment point for a compensation chain (not shown).

After the elevator car including the safety plank assembly 10 is installed in a hoistway, balancing weights (not shown) or compensation chains (not shown) are attached to the balancing weight brackets 58 and 60 as necessary to balance the elevator car with zero load on the shoes of the safety devices 23 and 25 with the elevator car at the middle of the car rise. The traction weights 36 are attached to the spacer members 34 as necessary for improving traction between the sheaves 50 and 54 and the suspension ropes.

Figure 4:
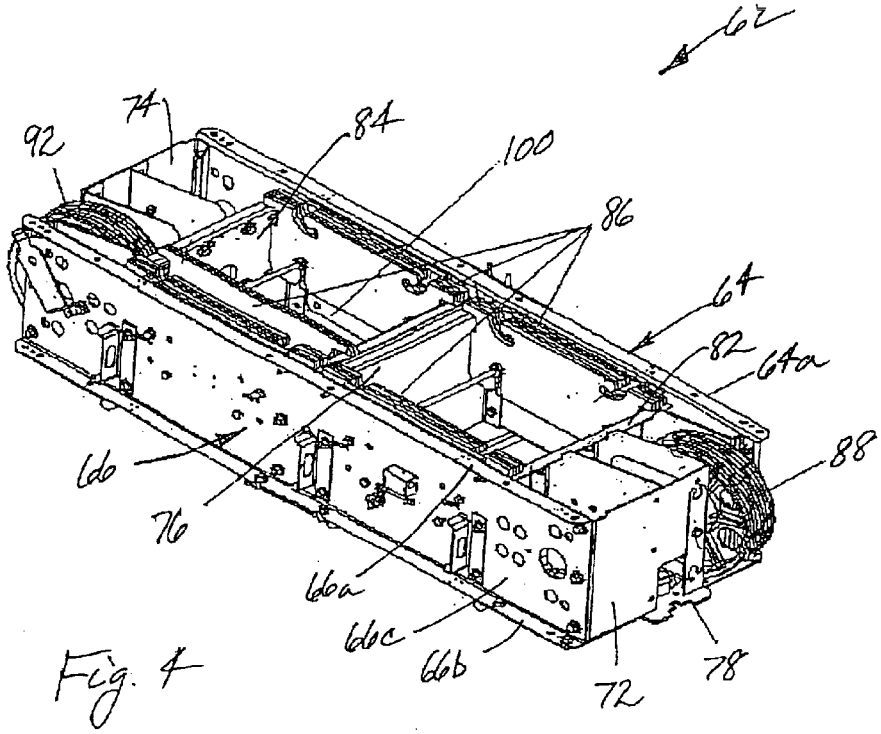
FIG. 4 is a perspective view of an alternative embodiment of a safety plank assembly in accordance with the present invention.
Figure 5:
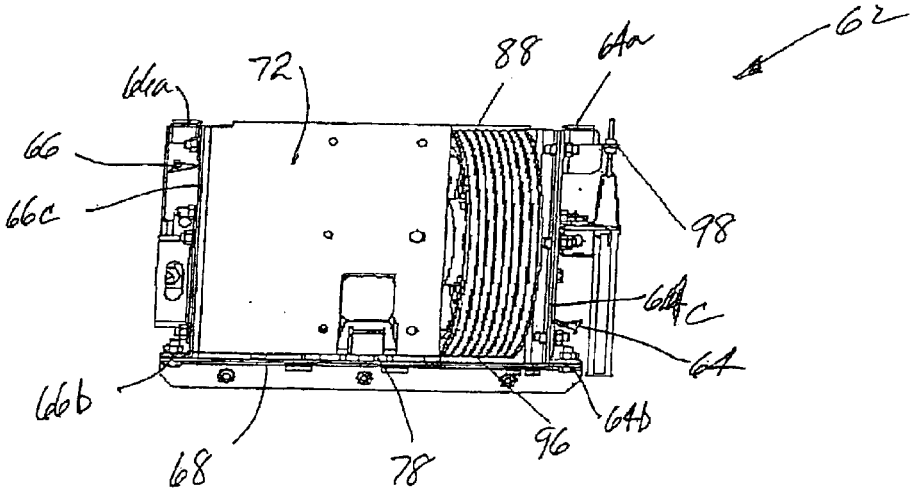
FIG. 5 is a right side view of the safety plank assembly shown in FIG. 4.
Figure 6:
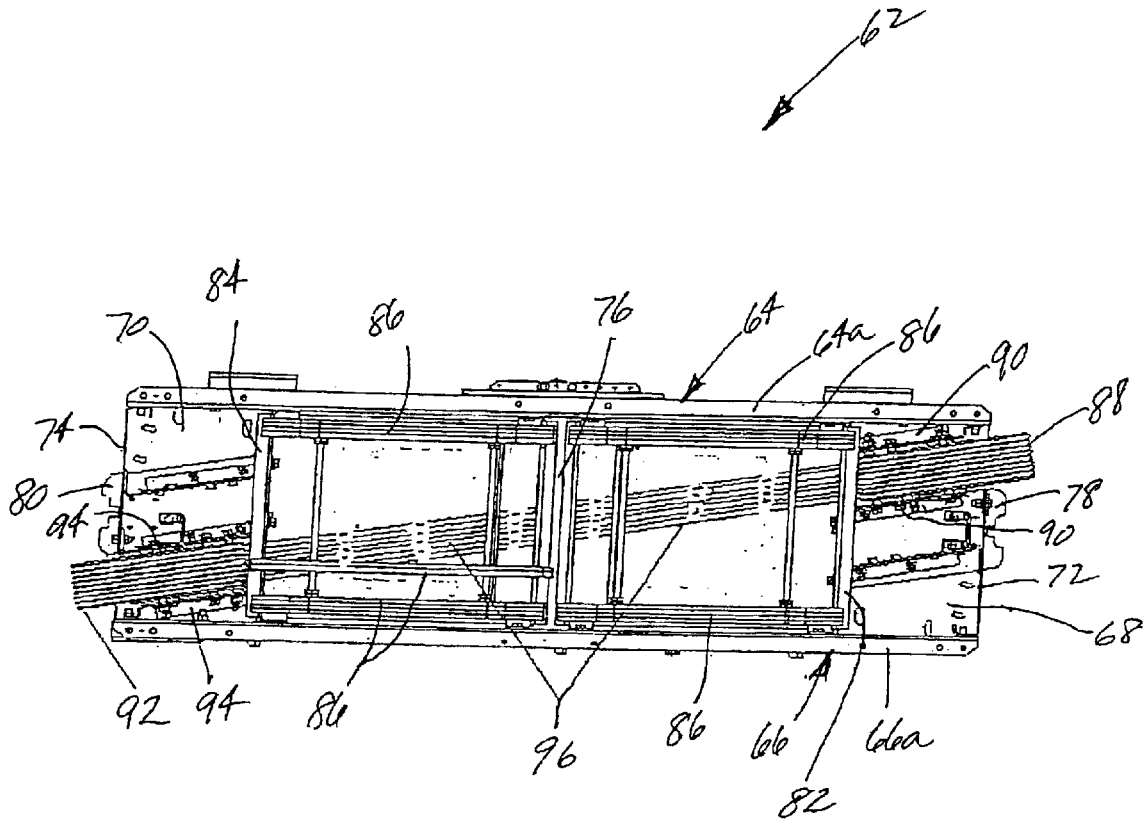
FIG. 6 is a top plan view of the safety plank assembly shown in FIG. 4.

Referring now to FIGS. 4, 5, and 6, an alternative embodiment of an elevator safety plank assembly is indicated generally at 62. The safety plank assembly 62 is operable to be attached to a lower surface of an elevator car (not shown) in a manner similar to the safety plank assembly 10. The safety plank assembly 62 includes a first plank beam 64 and a second plank beam 66 extending in vertical planes parallel with one another. The plank beams 64 and 66 have horizontally outwardly extending upper flanges 64*a* and 66*a*, horizontally outwardly extending lower flanges 64*b* and 66*b*, and vertically extending planar bodies 64*c* and 66*c* respectively. The plank beams 64 and 66 are preferably spaced about twenty-four inches apart.

The plank beams 64 and 66 are joined on opposed ends by a first bottom plate 68 and a second bottom plate 70. Extending upwardly from the plate 68 is a partial end wall 72 attached the plank beam 66. Extending upwardly from the plate 70 is a partial end wall 74 attached the plank beam 64. The plank beams 64 and 66 also are joined by a centrally located cross support member 76. A first safety mounting provision 78 is attached to the bottom plate 68 and extend outwardly under the end wall 72 for mounting a first safety device (not shown), such as an emergency brake. A second safety mounting provision 80 is attached in a similar manner to the second bottom plate 70 and extends outwardly from the end wall 74 for mounting a second safety device, such as an emergency brake.

The respective interior surfaces of the plank beams 64 and 66 are connected by a first transverse member 82 adjacent the first end wall 72 and a second transverse member 84 adjacent the second end wall 74. One or more traction and balancing weights 86 can be supported between the plank beams 64 and 66 by the cross support member 76 and either of the transverse members 82 and 84.

A first sheave 88 is rotatably mounted, such as by a roller bearing connection, between a pair of sheave gussets 90 attached to the first bottom plate 68. The sheave 88 extends outwardly between the first end wall 72 and the first plank beam 64. A second sheave 92 is rotatably mounted in a similar manner between a pair of sheave gussets 94 attached to the second bottom plate 70. The sheave 92 extends outwardly between the second end wall 74 and the second plank beam 66. The rope sheaves 88 and 92 function as an underslung sheave assembly and define a diagonal rope path 96 through the safety plank assembly 62. The ropes or cables (not shown) extend vertically down past the sides of the elevator car (not shown) engaging the sheaves 88 and 92, passing through the apertures 52 and 56 and passing through the safety plank assembly 62 along the rope path 96.

A travel cable hanger 98 can be provided on the outer surface of the first plank beam 64 for attaching a travel cable (not shown). A compensation chain attachment weight 100 can be provided, similar to the traction and balancing weights 86, but with a lower extension for attaching a compensation chain. After the elevator car including the safety plank assembly 62 is installed in a hoistway, the traction and balancing weights 86 or compensation chains (not shown) are attached as necessary to balance the elevator car with zero load on the shoes of the safety devices with the elevator car at the middle of the car rise and to improve traction between the sheaves 88 and 92 and the suspension ropes.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A safety plank assembly for an elevator car in a traction-type elevator system comprising:

a pair of plank beams extending parallel to one another and spaced apart;

a cross support member connected between said plank beams;

a pair of sheaves rotatably mounted at opposite ends of said plank beams, said sheaves being oriented diagonally with respect to parallel longitudinal axes of said plank beams to define a rope path through the safety plank assembly; and at least one weight mounting means attached to at least one of said plank beams for receiving at least one of a traction weight and a balancing weight.

2. The assembly according to claim 1 wherein said plank beams are C-shaped in profile each having an upper flange adapted to be attached to a bottom of an elevator car.

3. The assembly according to claim 1 including a pair of sheave beams attached to said cross support member, said sheaves being rotatably mounted on said sheave beams at said opposite ends of said plank beams.

4. The assembly according to claim 3 wherein said weight mounting means includes at least a pair of transverse spacer members connected between said sheave beams for supporting the at least one of a traction weight and a balancing weight.

5. The assembly according to claim 1 including a pair of end plates connected between said opposite ends of said plank beams, each of said end plates having an aperture formed therein through which an associated one of said sheaves extends.

6. The assembly according to claim 1 including a pair of safety mounting provisions attached at said opposite ends of said plank beams.

7. The assembly according to claim 1 wherein said weight mounting means includes at least one balancing weight bracket attached to one of said plank beams for retaining at least one balancing weight.

8. The assembly according to claim 1 wherein said weight mounting means includes at least a pair of transverse members connected between said plank beams for supporting the at least one of a traction weight and a balancing weight.

9. The assembly according to claim 1 including a pair of bottom plates connected between said opposite ends of said plank beams, each of said bottom plates having a pair of sheave gussets attached thereto, said sheaves being rotatably mounted on said sheave gussets.

10. The assembly according to claim 1 including a travel cable hanger attached to one of said plank beams.

11. A safety plank assembly for an elevator car in a traction-type elevator system comprising:

a pair of plank beams extending parallel to one another and spaced apart;

a connecting means connecting said plank beams together;

a pair of sheaves rotatably mounted at opposite ends of said plank beams, said sheaves being oriented diagonally with respect to parallel longitudinal axes of said plank beams to define a rope path through the safety plank assembly;

a pair of safety mounting provisions mounted at said opposite ends of said plank beams; and at least one weight mounting means attached to at least one of said plank beams for receiving at least one of a traction weight and a balancing weight.

12. The assembly according to claim 11 wherein said plank beams are C-shaped in profile each having an upper flange adapted to be attached to a bottom of an elevator car.

13. The assembly according to claim 11 including a pair of sheave beams attached to said connecting means, said sheaves being rotatably mounted on said sheave beams at said opposite ends of said plank beams, and wherein said weight mounting means includes at least a pair of transverse spacer members connected between said sheave beams for supporting the at least one of a traction weight and a balancing weight.

14. The assembly according to claim 11 wherein said weight mounting means includes at least one balancing weight bracket attached to one of said plank beams for retaining at least one balancing weight.

15. The assembly according to claim 11 wherein said weight mounting means includes at least a pair of transverse members connected between said plank beams for supporting the at least one of a traction weight and a balancing weight.

16. The assembly according to claim 11 including a pair of bottom plates connected between said opposite ends of said plank beams, each of said bottom plates having a pair of sheave gussets attached thereto, said sheaves being rotatably mounted on said sheave gussets.

17. The assembly according to claim 11 including a travel cable hanger attached to one of said plank beams.

18. A safety plank assembly for an elevator car in a traction-type elevator system comprising:

a pair of plank beams extending parallel to one another and spaced apart;

a cross support member connecting said plank beams together intermediate opposite ends of said plank beams;

a pair of sheaves rotatably mounted at said opposite ends of said plank beams, said sheaves being oriented diagonally with respect to parallel longitudinal axes of said plank beams to define a rope path through the safety plank assembly;

a pair of safety mounting provisions mounted at said opposite ends of said plank beams; and at least one weight mounting means attached to at least one of said plank beams for receiving at least one of a traction weight and a balancing weight.

19. The assembly according to claim 18 including a pair of sheave beams attached to said cross support member, said sheaves being rotatably mounted on said sheave beams at said opposite ends of said plank beams, and wherein said weight mounting means includes at least a pair of transverse spacer members connected between said sheave beams for supporting the at least one of a traction weight and a balancing weight.

20. The assembly according to claim 18 wherein said weight mounting means includes a pair of balancing weight brackets each attached to one of said plank beams for retaining at least one balancing weight.

* * * * *